US007823654B2

(12) United States Patent
Kennett

(10) Patent No.: US 7,823,654 B2
(45) Date of Patent: Nov. 2, 2010

(54) ELECTRIC POST DRIVER

(75) Inventor: David Kennett, Auckland (NZ)

(73) Assignee: Ramet Holdings Ltd (NZ)

( * ) Notice: Subject to any disclaimer, the term of this patent is extended or adjusted under 35 U.S.C. 154(b) by 150 days.

(21) Appl. No.: 10/573,021

(22) PCT Filed: Sep. 17, 2004

(86) PCT No.: PCT/NZ2004/000223

§ 371 (c)(1),
(2), (4) Date: Mar. 22, 2006

(87) PCT Pub. No.: WO2005/028758

PCT Pub. Date: Mar. 31, 2005

(65) Prior Publication Data

US 2007/0039748 A1 Feb. 22, 2007

(30) Foreign Application Priority Data

Sep. 22, 2003 (NZ) ..... 528332

(51) Int. Cl.
*B25D 13/00* (2006.01)

(52) U.S. Cl. ..... 173/117; 173/91; 173/112; 173/114; 173/184; 310/13

(58) Field of Classification Search ..... 173/112, 173/114, 117, 127, 206; 310/15
See application file for complete search history.

(56) References Cited

U.S. PATENT DOCUMENTS 2,870,675 A * 1/1959 Salisbury ..... 89/1.1
2,967,302 A * 1/1961 Loveless ..... 173/117
3,548,273 A * 12/1970 Vallauri et al. ..... 318/135
3,610,972 A * 10/1971 Pelenc ..... 310/13
3,616,763 A * 11/1971 Colling ..... 104/294
3,648,084 A * 3/1972 Laithwaite et al. ..... 310/13
3,772,539 A * 11/1973 Izhelya et al. ..... 310/13
3,828,236 A * 8/1974 Close ..... 318/561
3,922,869 A * 12/1975 Wisotsky ..... 405/228
4,124,081 A * 11/1978 Deike ..... 173/28
4,131,166 A * 12/1978 Schnell ..... 173/193
4,215,297 A * 7/1980 Jacquemet ..... 318/130
4,305,736 A * 12/1981 Kahl et al. ..... 96/36
4,390,307 A * 6/1983 Rice ..... 405/228

(Continued)

FOREIGN PATENT DOCUMENTS

DE 2507676 9/1976

(Continued)

*Primary Examiner*—Rinaldi I. Rada
*Assistant Examiner*—Lindsay Low

(57) ABSTRACT

An impact driver for driving elongate objects into a body has, a chassis, a ram supported by the chassis in a manner allowing rectilinear movement of the ram relative to the chassis between two limits, and a linear induction motor. The linear induction motor has a stator mounted to the chassis and positioned to operatively interact with a linear induction motor reaction member being of a conductive metal material. The reaction member is carried by the ram in a manner to allow the ram to oscillate between the two limits by the stator of the linear induction motor. A first limit being a retracted position and a second limit being an impact position to which the ram is accelerated from the retracted condition by the stator and at which the ram imparts an impact force on the elongate object in the elongate direction thereof.

26 Claims, 10 Drawing Sheets

Figure 1:
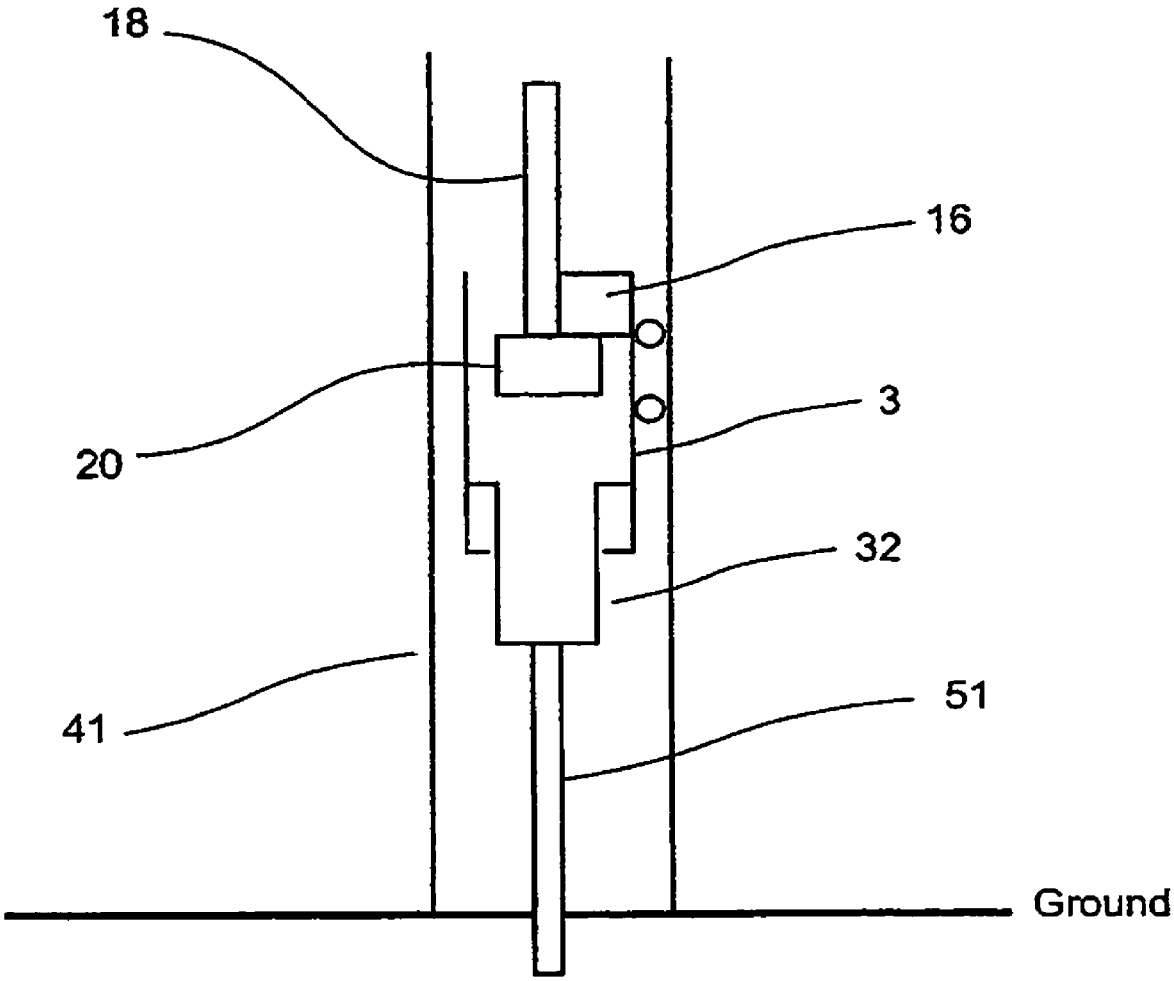

U.S. PATENT DOCUMENTS 4,462,529 A * 7/1984 Ladouceur ..... 226/125
4,468,594 A * 8/1984 Jacquemet ..... 318/130
4,494,613 A * 1/1985 Tamaki et al. ..... 173/74
4,747,455 A * 5/1988 Cunningham ..... 173/1
4,799,557 A * 1/1989 Jacquemet ..... 173/91
4,817,734 A * 4/1989 Kuehn ..... 173/29
4,844,661 A * 7/1989 Martin et al. ..... 405/232
5,168,938 A * 12/1992 Sano et al. ..... 173/11
5,248,001 A * 9/1993 Moseley ..... 173/1
5,257,879 A * 11/1993 Veronelli ..... 405/228
5,449,253 A * 9/1995 Roger ..... 405/245
6,201,362 B1 * 3/2001 DeMichelis ..... 318/126
6,257,352 B1 * 7/2001 Nelson ..... 173/211
6,313,552 B1 * 11/2001 Boast ..... 310/14
6,427,987 B1 * 8/2002 Campling et al. ..... 267/69
6,462,439 B1 * 10/2002 Denne ..... 310/17
6,541,880 B2 * 4/2003 Okada et al. ..... 310/12
6,564,882 B2 * 5/2003 Durmeyer et al. ..... 173/117
6,796,477 B2 * 9/2004 Chen ..... 227/2
6,830,173 B2 * 12/2004 Barber et al. ..... 227/131
6,966,390 B2 * 11/2005 Campling ..... 173/202
7,204,403 B2 * 4/2007 Kenney et al. ..... 227/133
2002/0050743 A1 * 5/2002 Okada et al. ..... 310/12
2003/0127917 A1 * 7/2003 Kang et al. ..... 310/12
2007/0110521 A1 * 5/2007 Nimens ..... 405/232

FOREIGN PATENT DOCUMENTS

EP 0024207 4/1983

* cited by examiner

ELECTRIC POST DRIVER

This is a nationalization of PCT/NZ2004/000223 filed 17 Sep. 2004 and published in English.

FIELD OF THE INVENTION

The present invention relates to impact drivers and in particular to an impact driver which utilises a linear motor.

In particular although not solely the present invention relates to a linear induction motor impact driver for use in the driving of poles, piles or posts although it will be appreciated that the invention herein described will have application to many other situations.

BACKGROUND

Post or pile drivers mostly rely on conversion of potential energy to achieve impact forces for the purposes of driving a post or pole into the ground. Such post drivers are most commonly used in farming, horticultural and agricultural situations and can be significantly large devices as a suitable force required to drive a pole or post commonly used in such situations into the ground, will require a force in the order of 2000 N. Such commonly known post drivers rely on the elevation of a heavy weight suspended above the end of a post, the elevation providing the weight with a potential energy which when released to fall onto the end of the post, generates sufficient kinetic energy to impart a sufficiently large force onto the end of the post to thereby drive the post into the ground. Traditionally, it has only been the conversion of potential energy (resultant from the elevation) to kinetic energy which was relied on. Hence the greater the force required, the greater the elevation necessary. Other machines rely on techniques based on mechanical energy storage. Such may be provided by springs or fast release hydraulic or steam cylinders to create an acceleration greater than that provided by gravity. These existing designs tend to be very heavy due the high driver mass (of some 200 kg) and the associated support structure, or they are only suitable for driving steel posts of small cross section (hence low in ground resistance) such as waratahs.

As the driving of posts into the ground requires large forces to overcome the frictional resistance of the ground into which the post is being driven, existing post driver designs tend to rely on heavy mass acceleration and are hence in general heavy and cumbersome requiring specialist transport needs. They are not well suited to difficult terrain or for rapid transportation between jobs.

As might be expected the high weight units can only be used with or mounted on large farm tractors because of the high mass that needs to be supported as well as the significantly large energy source that is required for the lifting of the weight or the energisation of any stored energy devices.

Furthermore since many known devices often take advantage only of gravity for the creation of kinetic energy, higher elevation is required for kinetic energy. However such height does place significant restrictions on the types of situations that a known post driver can be utilised. It is not uncommon for posts to be required to be driven within confined spaces such as for example within greenhouses or underneath existing buildings. Those devices relying purely on gravity to accelerate the impact mass also have no application where posts are to be driven in a horizontal or near horizontal direction.

As such it is an object of the present invention to provide an impact driver which overcomes the abovementioned disadvantages or which will at least provide the public with a useful choice.

BRIEF DESCRIPTION OF THE INVENTION

Accordingly in a first aspect the present invention consists in an impact driver for driving elongate objects into a body, said impact driver comprising a. a chassis b. a ram supported by said chassis in a manner allowing rectilinear movement of said ram relative to said chassis between two limits, c. a linear induction motor having a stator mounted to said chassis and positioned to operatively interact with a linear induction motor reaction means being of a conductive metal material, said reaction means carried by said ram in a manner to allow the ram to oscillate between said two limits by the stator of said linear induction motor, a first limit being a retracted position and a second limit being an impact position to which the ram is accelerated from said retracted condition by said stator and at which said ram imparts an impact force on said elongate object in the elongate direction thereof.

Preferably said ram includes a means defining an impact head and an elongate ram support structure, said ram support structure having a first and second distal ends, said impact head provided at a first distal end of said ram support structure, said reaction means being of an elongate nature and engaged to and extending in the elongate direction of said ram support structure between said first and second distal ends thereof.

Preferably said ram includes a means defining an impact head and said reaction means, said reaction means being of an elongate nature and having a first and second distal end, said impact head provided at a first distal end.

Preferably said impact head is of a robust and substantially solid material.

Preferably said reaction means is an elongate structure.

Preferably said reaction means comprises at least one plate of a conductive metal material.

Preferably said ram bears with said chassis in a manner to allow rectilinear movement of said ram relative to said chassis.

Preferably said chassis provides ram bearing means which locate said ram with said chassis.

Preferably said ram bearing means is located within a casing of said chassis, said, ram also at least in part provided and retained by said bearing means within said casing of said chassis.

Preferably said stator of said linear induction motor is positioned within the casing of said chassis.

Preferably said chassis includes a casing defining an elongate chamber within which at least part of said ram is able to move in the elongate direction.

Preferably the relative position of said ram at least when in one position with respect to said chassis is able to be sensed by an electronic sensor.

Preferably a said electronic sensor is a limit sensor detecting the reaching of the ram to or proximate to its retracted position.

Preferably a said electronic sensor is in communication with control means of the linear induction motor to trigger the control means to accelerate the hammer from the retracted position to the impact position.

Preferably said stator is controlled to accelerate the ram from the retracted position to the impact position at a rate greater than from the impact position to the retracted position.

Preferably a anvil assembly is positioned relative to said chassis to hold an anvil in alignment to the rectilinear direction of movement of said ram to be interposed between the head of said elongate object and said impact head for the purpose of providing a cushioning to the impact force of said ram applied to said elongate object.

Preferably said anvil assembly is in a translatable engagement with said chassis.

Preferably said anvil assembly presents said anvil at a location remote from said chassis.

Preferably said chassis is mounted to a support structure.

Preferably said chassis is mounted to a support structure and said anvil assembly is in a translatable engagement with said support structure to permit its movement relative thereto and parallel to the rectilinear direction of movement.

Preferably said chassis is mounted to a support structure.

Preferably said support structure includes a means to mount to a vehicle.

Preferably said means to mount allows said support structure to rotate relative to said vehicle.

Preferably said means to mount allows said support structure to translate relative to said vehicle.

Preferably said chassis is mounted to a support device selected from one of a vehicle, a vessel and a derrick.

Preferably said chassis is connected to the support device by an articulatable connection means.

Preferably the impact driver is a pile driver.

Preferably the overall operational height of the impact driver remains less than 3 m.

Preferably the overall operational height of the impact driver remains less than 2.5 m.

Preferably the overall operational height of the impact driver remains less than 2.0 m.

Preferably the overall operational height of the impact driver remains less than 1.5 m.

In a second aspect the present invention consists in a double acting driver for driving elongate objects into a body said driver including a ram which relies on power from a linear induction motor stator and gravity to accelerate the ram during its compression stroke.

In a further aspect the present invention consists in a driver for driving elongate objects into a body said driver including a ram which relies on power from a linear induction motor stator to accelerate the ram during its compression stroke.

In a further aspect the present invention consists in a method of driving elongate objects into a body utilising the impact driver as hereinbefore described.

In a further aspect the present invention consists in a method of pile driving utilising the impact driver as hereinbefore described.

In a further aspect the present invention consists in a method of driving elongate objects into a body utilising gravity to accelerate an impact ram to impact the head of an elongate and a linear induction motor stator interacting with a reactor plate of said ram, to enhance acceleration of the ram beyond 9.81 m/s2 during its compression stroke.

In a further aspect the present invention consists in a driver for driving elongate objects into a body said driver including a ram which is accelerated by assistance of gravity and by a linear induction motor stator interacting with a reactor plate of said ram to enhance acceleration of the ram beyond 9.81 m/s2 during its compression stroke.

In a further aspect the present invention consists in an elongate object extraction device for extracting elongate objects from body said device including a ram which relies on power from a linear induction motor stator to accelerate the ram during its extracting stroke, said ram including means to engage with said elongate object to subject it to a force from the ram during its extraction stroke.

In a further aspect the present invention consists in an elongate object extraction device for extracting elongate objects from a body, said device comprising a. a chassis b. a ram supported by said chassis in a manner allowing rectilinear movement of said hammer relative to said chassis between two limits, c. a linear induction motor having a stator mounted to said chassis and positioned to operatively interact with a linear induction motor reaction means being of a conductive metal material, said reaction means carried by said ram in a manner to allow the ram to oscillate between said two limits by the stator of said linear induction motor, a first limit being an elongate object proximate more position and a second limit tending towards an extraction position to which the ram is accelerated from said proximate more position by said stator and at which said elongate object is or tends towards being extracted from said object.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

BRIEF DESCRIPTION OF. THE DRAWINGS

Figure 2:
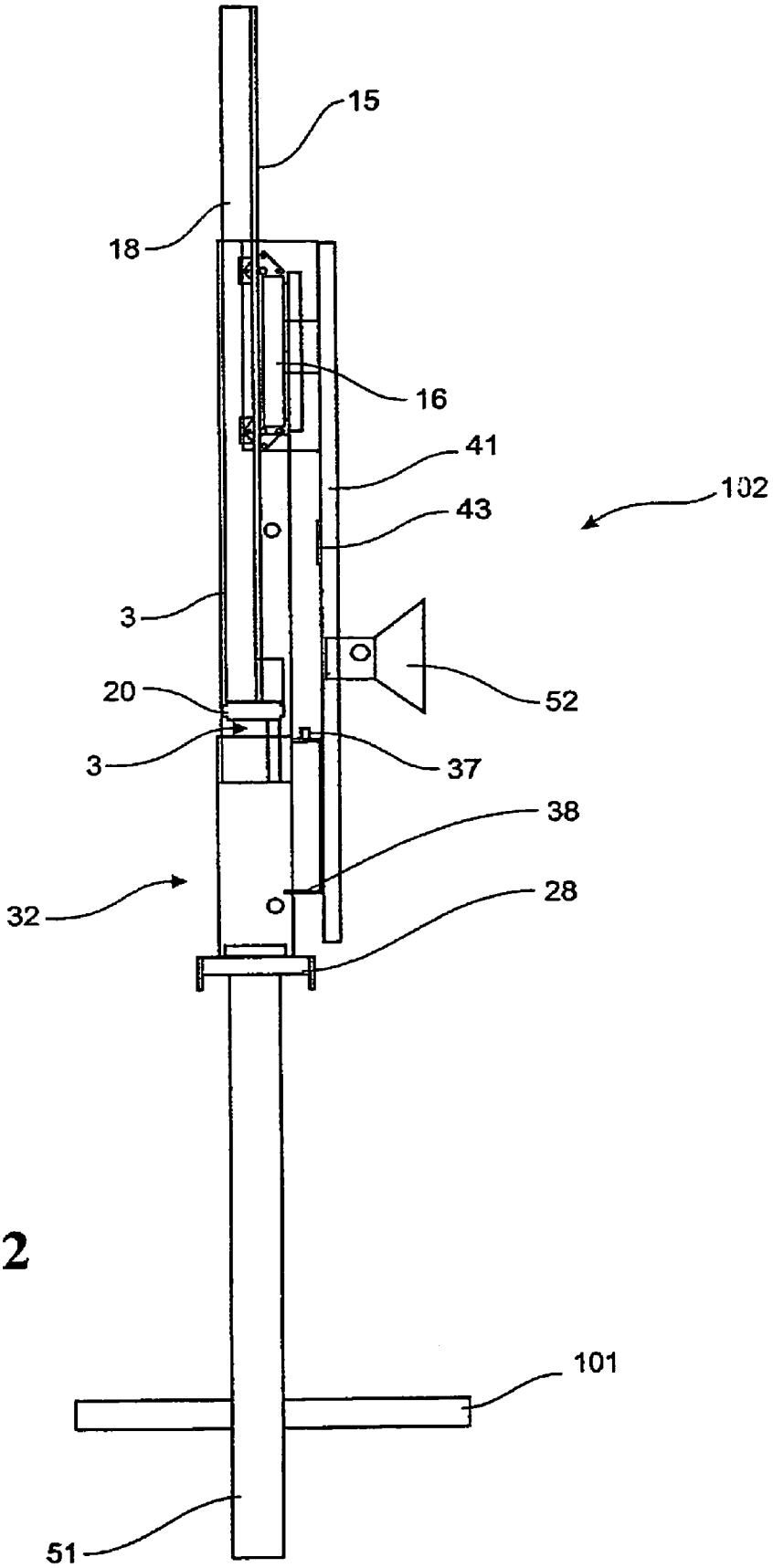
Figure 3:
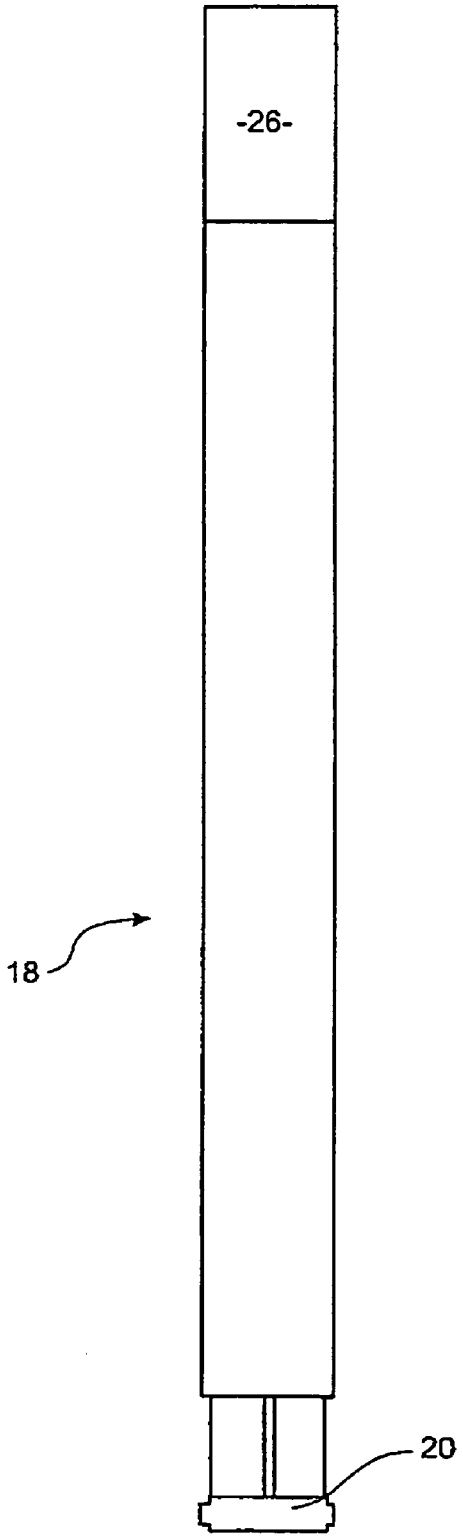
Figure 4:
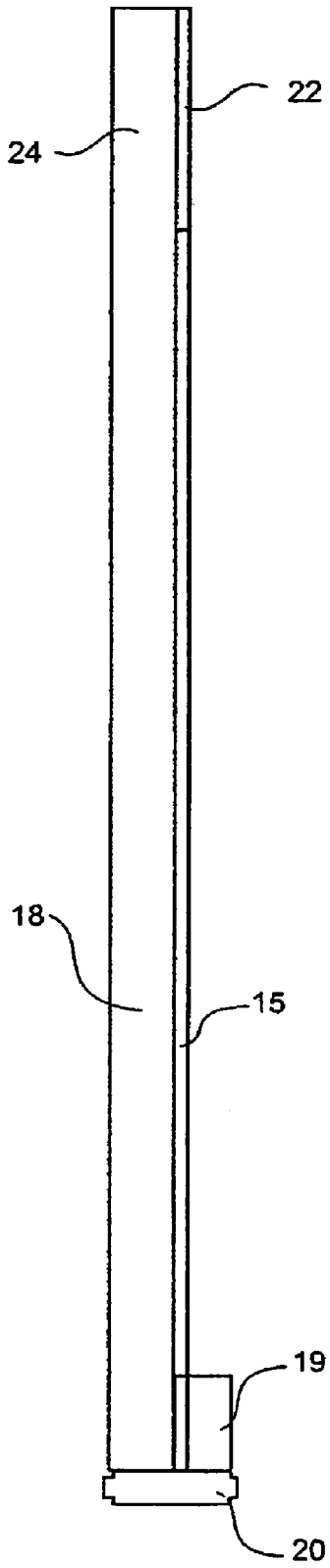
Figure 5:
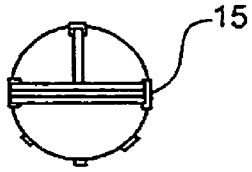
Figure 6:
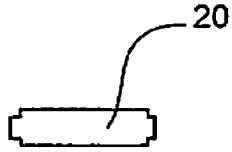
Figure 7:
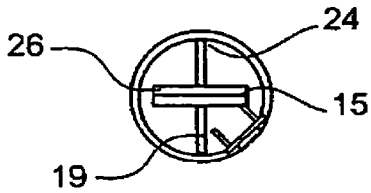
Figure 10:
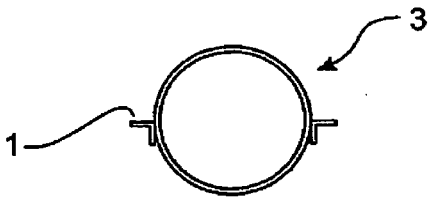
Figure 11:
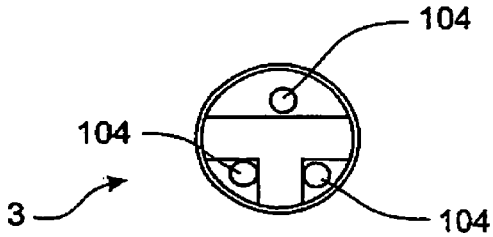
Figure 8:
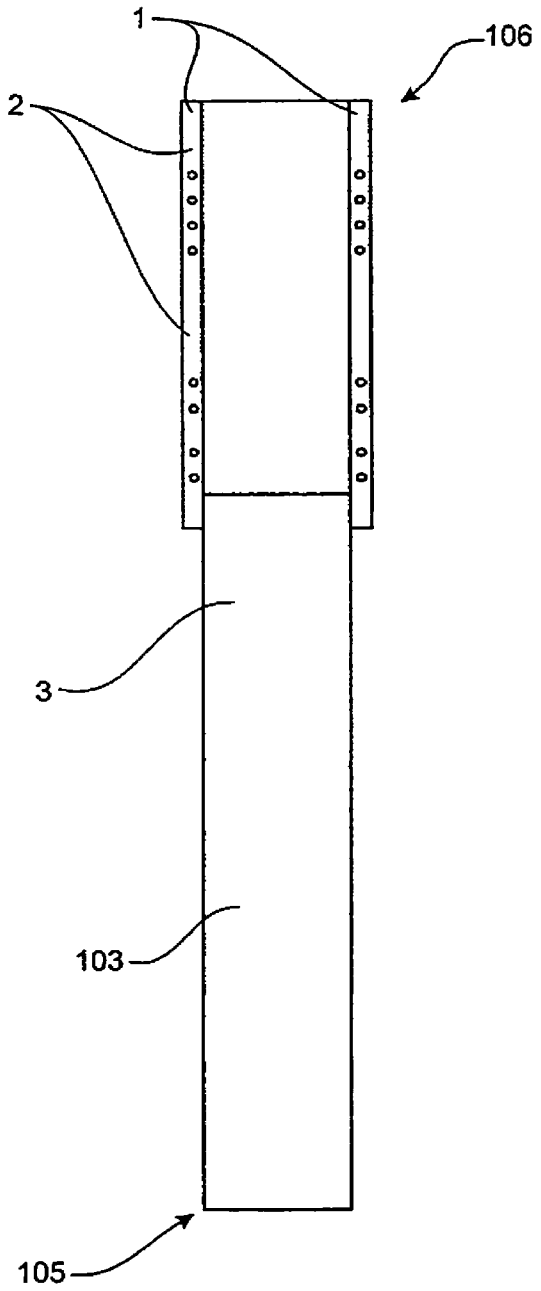
Figure 9:
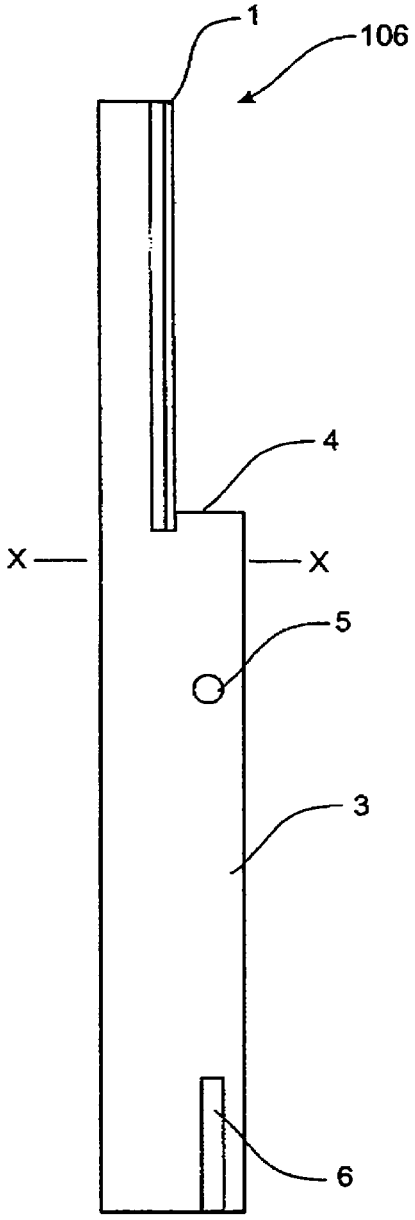
Figure 12:
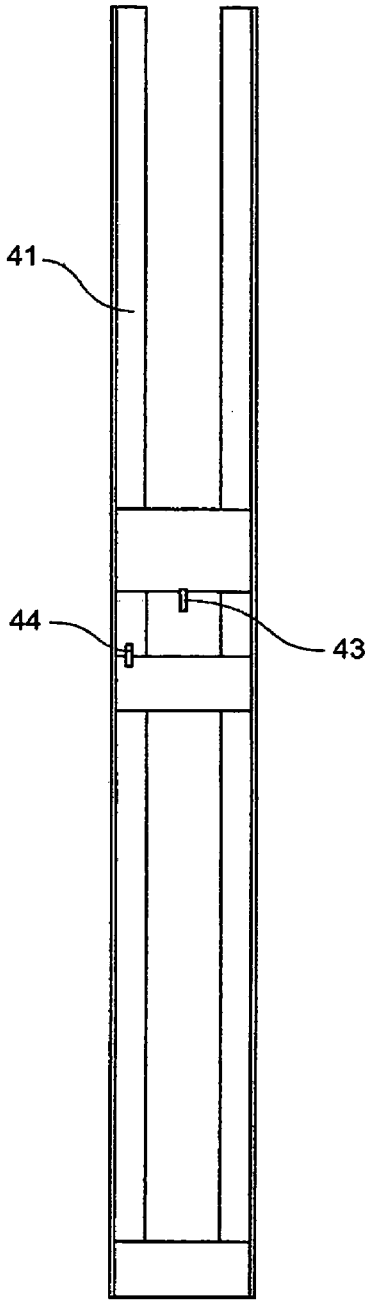
Figure 13:
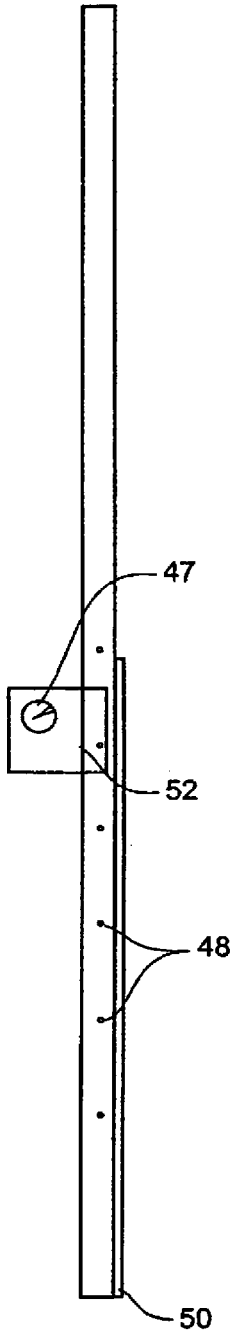
Figure 14:
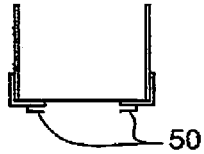
Figure 15:
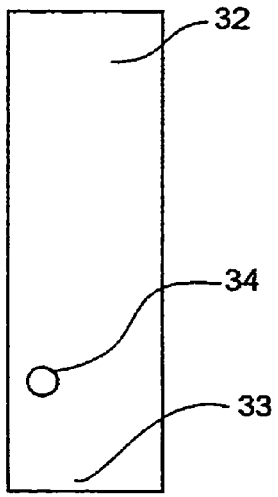
Figure 16:
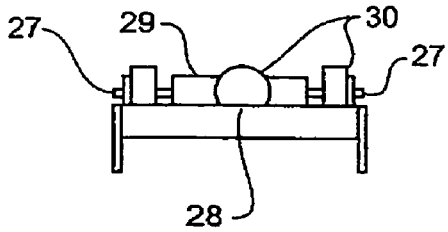
Figure 17:
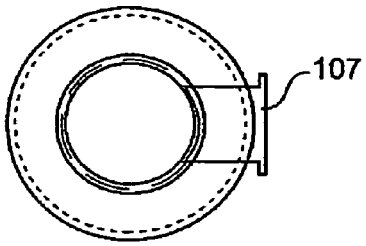
Figure 18:
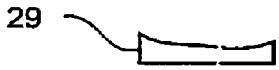
Figure 19:
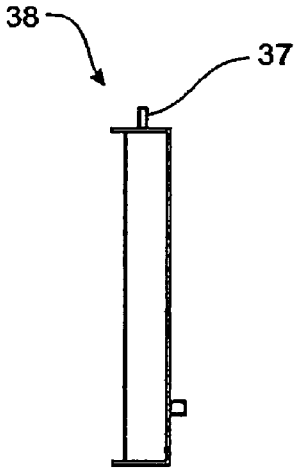
Figure 20:
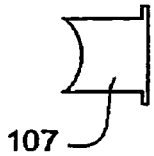
Figure 21:
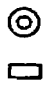
Figure 22:
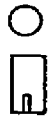
Figure 23:
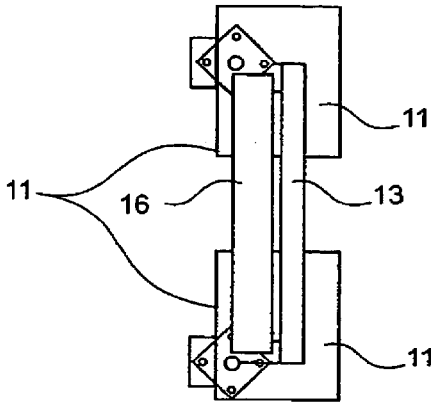
Figure 24:
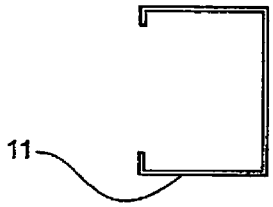
Figure 25:
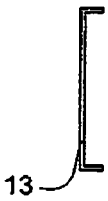
Figure 26:
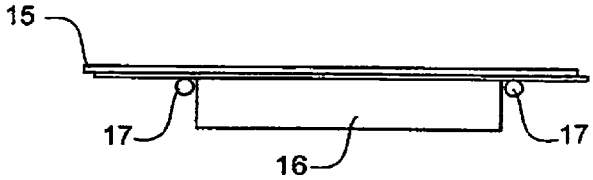

FIG. 1 is a schematic view of the primary components of the impact driver of the present invention, FIG. 2 is a more detailed schematic drawing of the primary and some of the more detailed components of the impact driver of the present invention, FIG. 3 is a side view of the ram/reactor support, FIG. 4 is a front view of the ram/reactor support of FIG. 3, FIG. 5 is a plan view of the ram/reactor support of FIGS. 3 and 4, FIG. 6 is a side view of the ram head, FIG. 7 is a bottom view of the ram/reactor support of FIGS. 3 and 4, FIG. 8 is a front view of the chassis to the ram/reactor support, FIG. 9 is a side view of the chassis of FIG. 8, FIG. 10 is a plan view of the chassis of FIGS. 8 and 9, FIG. 11 is a sectional view through section XX of FIG. 9, FIG. 12 is a front view of the exterior support frame to which the chassis is mounted, FIG. 13 is a side view of the support frame of FIG. 12, FIG. 14 is a plan view of the support frame of FIG. 12, FIG. 15 is a side view of the anvil support tube, FIG. 16 is a side view of the anvil to be engaged to the lower end of the anvil support tube, FIG. 17 is a plan view of the anvil of FIG. 16, FIG. 18 is a side view of the impact pad of the anvil of FIG. 16, FIG. 19 is a side view of the support bracket to support the anvil support tube from the support frame of FIGS. 12-14, FIG. 20 is a bottom view of the anvil support tube bracket of FIG. 20, FIG. 21 is a plan and side view of the sensor bracket which is secured to the anvil tube to position a location sensor in place in location with said anvil support tube, for the purpose of sensing the telescopic extension of the anvil from the chassis, as to at least detect the limit of movement thereof, FIG. 22 is a plan and side view of a sensor cover for the purposes of protecting the sensor, FIG. 23 is a side view of the stator of the Linear Induction Motor (LIM) and related support bracket, FIG. 24 is a plan view of the two LIM support brackets, FIG. 25 is a side view of the LIM bracket to hold the LIM, and FIG. 26 is a side view of the LIM.

Figure 27:
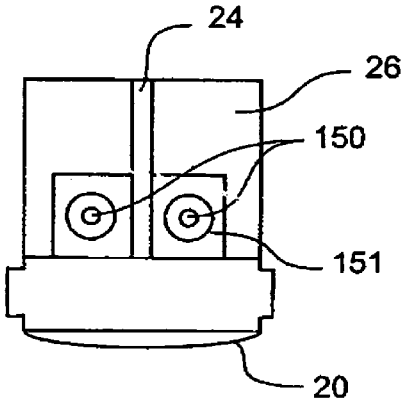
Figure 28:
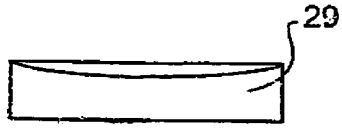
Figure 29:
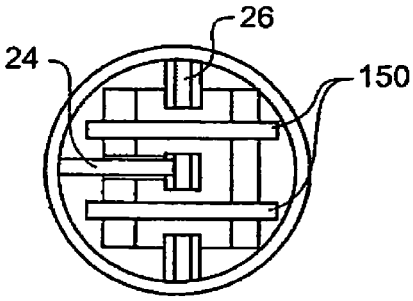
Figure 30:
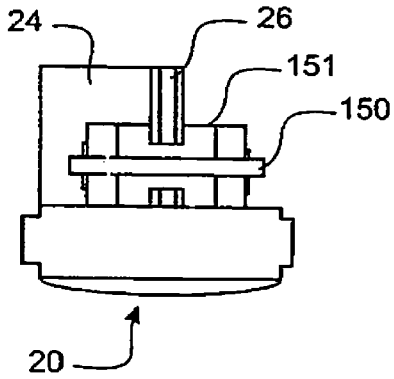

FIG. 27 is a side view of the end of the ram showing the impact head 20 engaged to the support structure 26/24, FIG. 28 is a side view of the cushion 29, FIG. 29 is a plan view of FIG. 27 and illustrates that the impact head 20 is supported by the support structure 26/24 by being bolted using bolts 150 which are supported by a rubber bush 151, FIG. 30 is another side view of the impact head 20 engaged to the support.

With reference to FIG. 2, there is shown an impact driver 102 engaged with a post 51 partly driven into the ground 101.

Figure 31:
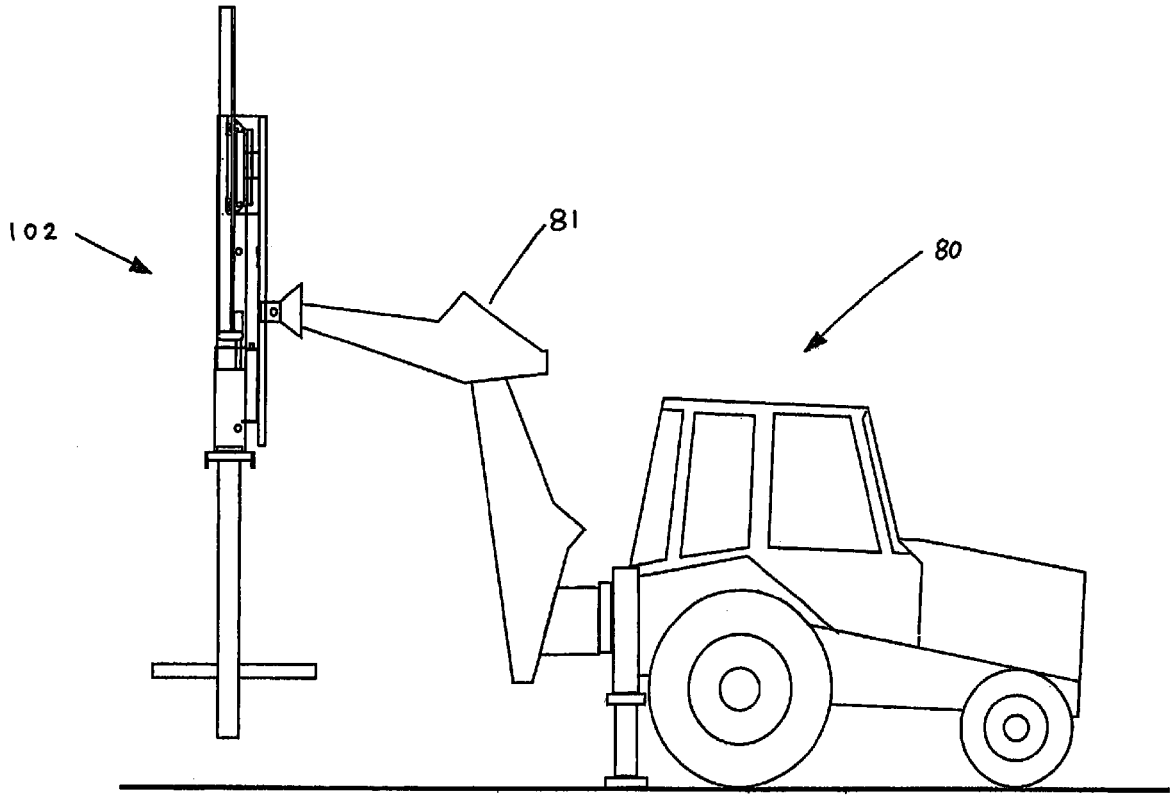

FIG. 31 illustrates an impact driver supported by an excavator boom.

DETAILED DESCRIPTION OF THE INVENTION

In the most preferred form the impact driver 102 consists of five primary components. These are namely the chassis 3, the ram/reactor support 18, an anvil 32, a linear induction motor (LIM) 16 (i.e., the stator component of an LIM) and a support frame 41 which supports the entire impact driver 102 and which may include a mounting bracket 52 to allow the impact driver 102 to be supported from a vehicle or vessel or the like.

At the core of the impact driver 102 is the LIM stator 16 and the cooperative reactor plate 15. The manner in which an LIM operates is well known and the details of LIM technology will not be described. The LIM 16 is presented to impart a reaction force onto the reactor plate 15 of the hammer/reactor support 18 to accelerate it and displace it in an oscillating manner between two limits of its movement.

This invention relies on an LIM to propel a driving mass of the ram 18 of for example 30 kg with sufficient acceleration to generate an effective and repeating impact force. The driving mass is provided in the form of a ram/reactor support 18 supported by a frame to maintain the ram above the driven post. The ram preferably is positioned to impact the post with a force in the longitudinal of the post and preferably to impact on the head of the post.

An electronic controller provides the means to raise or lower the ram, to activate the driving sequence safety cut out control optionally also adjust the angular position. The driving sequence provides for a single or continuous impact cycling at a rate of many cycles per minute. Most items of the impact driver can be made from aluminium in a manner to reduce overall weight and ensure a modular, scalable construction.

The reactor plate 15 forms part of the ram/reactor support 18 as shown in FIGS. 3-7. The reactor plate is of a highly conductive material which can carry a current and is preferably made from a multilayer assembly of a plate of aluminium (proximate most to the LIM stator 16) and a backing plate of steel. The most effective configuration of reactor plate is normally specified by the manufacturer or supplier of the LIM. The reactor plate 15 is an elongate plate (preferably rectangular) which is supported by an elongate support structure which may include for example a T-shaped support including a backing plate 26 and a re-enforcing flange 24. A substantially T-shaped section ensures that the reactor plate 15 is rigidly supported and prevented from warping and bending. The reactor plate may alternatively be of another elongate shape. The ram/reactor support 18 is an elongate body. It is in this elongate direction that the movement of the ram/reactor support 18 is actuated by the LIM stator 16. The ram/reactor support 18 includes an impact head 20 provided at its distal end which is of a mass which when accelerated by the LIM generates the necessary kinetic energy to impart an impact force for the purposes of driving an object such as a post or pile. The impact head 20 is rigidly connected to the support structure 26/24 of the ram/reactor support 18. Alternatively rubber bearings or a bush may be provided interfacing between the impact head 20 and the support structure 26/24 as for example shown in FIGS. 27, 27, 30. The provision of such a rubber bush 151 will reduce the impact loading created at the connection between the impact head 20 and the support structure 26/24 which will enhance the fatigue life of the connection.

The reactor plate 15 is of a sufficient length to span at least the distance of desired travel of the ram/reactor support 18 relative to the LIM stator 16.

The ram/reactor support 18 is disposed within at least part of a chassis 3 with which it is mounted for movement in the longitudinal direction. The chassis 3 is likewise also an elongate body designed to allow for the travel of the ram/reactor support 18 in a longitudinal direction relative thereto. The chassis 3 preferably supports the ram/reactor support 18 in a manner to allow it to travel linearly and in its longitudinal direction. The chassis 3 includes an enclosed and preferably circular cross sectioned support portion 103 within which the ram/reactor support 18 is able to move. The ram/reactor support 18 preferably snugly locates within the support portion 103 of the chassis and is supported for linear movement by bearings. Such support prevents any movement of the ram/reactor support 18 other than linear movement within and relative to the chassis 3.

Incorporated within the chassis 3 are rubber buffers 104 which serve the purpose of providing shock absorption of any overrun of the ram/reactor support 18 in the fully retracted position. The rubber buffers 104 for example are provided at the upper regions of the support portion 103. The buffers 104 can make contact with the impact head 20 when the impact head 20 approaches and perhaps overruns the preferred top limit of movement so as to prevent the rain/reactor support 18 from running the beyond the preferred upper limit and the ram coming in contact with the LIM stator 16 or related support chambers.

The support portion 103 of the chassis 3 is preferably of a pipe section and includes towards its first distal end 105 a slot 6. The slot 6 is provided for the purposes of receiving the sensor provided at location 34 of the anvil body 32.

Inwardly from its second distal end 106, the chassis 3 includes a cutout 4. The cutout 4 is a cutaway of part of the pipe of the chassis 3 and is a region at where the linear motor 16 is mounted to the chassis 3. The cutout 4 has mounting means 1 at its periphery which provide a support for supporting the LIM unit. The support frame 1 preferably consists of angle 2 which is for example welded to the exterior of the pipe section of the chassis 3 and includes apertures for receiving fastening means to fasten the LIM unit, to the chassis 3. The LIM bracket carries the LIM.

The LIM unit shown in side view in FIG. 23, is mounted to the mounting bracket 1 of the chassis 3. The LIM unit retains the LIM 16 stator with the chassis 3, the LIM stator 16 is able to interact with the reactor plate 15 of the ram 18. The LIM unit of FIG. 23 preferably includes the LIM stator 16, an LIM bracket 13 which itself is engaged to end support frames 11 of the LIM unit FIG. 23. A spacer bearing 17 on each side of the LIM stator 16 is provided to ensure that the reactor plate 15 is spaced away from the LIM a distance, of approximately 3 mm, so as to prevent their contacting.

The LIM support frames 11 are secured in a fixed relationship to the support frame 41. As such, the support frame 41 holds the LIM unit of FIG. 23 in a fixed relationship. As the LIM unit is affixed to the chassis 3, the support frame 41 also holds the chassis 3 in a fixed relationship relative thereto.

The support frame 41 includes support brackets 52 which may include a bearing or bearing support aperture 47 to define a pivotable mounting for the support frame 41 from a vehicle, vessel or derrick. This ability to pivot will allow for the adjustment of the position of the impact driver 102 relative for example to the vehicle from which it is supported. While such support may be directly from a vehicle, alternatively the impact driver 102 may be supported indirectly from a vehicle 80 by for example a boom such as an excavator boom 81 or other arm which may be articulatable/extendable/rotatable relative to the vehicle. In one embodiment the present invention may be mounted from an arm such as one commonly found on an excavator. In such a manner, the impact driver 102 may be positionable in substantially any desired location and in any desired direction relative to the vehicle from which it is supported.

The support frame 41 also includes a guide track 50 which is provided for the guided movement therealong of an anvil assembly 32. The anvil assembly 32 includes an anvil 28, often also known as an impact block or striker plate and transmits the blow from the ram to the pile or post. The anvil assembly 32 preferably consists of a support tube 33 which is in sliding engagement with both the guide track 50 of the support frame 41 and the chassis 3. The anvil support tube 33 is preferably of an inside diameter to locate snugly over the exterior of the chassis 3. Such support may be by the use of bearings or may be a direct sliding (e.g. telescopic) support established between the inside diameter of the support tube 33 and the external diameter of the chassis 3 at least inwardly from the first distal end 105 and at least partially in support by the support portion 103 of the chassis 3.

The anvil assembly 32 includes an anvil 28 provided at one of the ends of the support tube 33, being that end unassociated directly with the chassis 3. The anvil 28 is supported by the anvil support tube 33. The anvil 28 is that part of the anvil assembly 32 which is to be located on the end of a post 51. The anvil assembly 32 is that portion with which the impact head 20 of the ram/reactor support 18 impacts. Some shock absorbing elements such as rubber shock absorbers 30, and an impact pad or cushion 29 against which the impact head 20 imparts its impact energy may also form part of the anvil 28. The impact pad 29 preferably has a concave upper surface. The impact head 20 preferably has a convex free surface (as for example shown in FIG. 27) which is shaped to be complimentary with the concave surface of the impact pad 29. The mating of the impact pad 29 with the impact head 20 and where a curved relationship exists between the two surfaces of contact, will reduce any point loading that may occur between the two elements. The shock absorbing elements may be supported by a perimeter flange 27 of the anvil 28.

The anvil assembly 32 is by an anvil support bracket 38 located with the guide track 50 of the support frame 41. The anvil support bracket 38 preferably includes a pulley mount 37 which is or with which a pulley can engage. By way of a cable or rope spanning between the pulley engaged to the pulley mount 37 and a pulley 34 of the support frame 41, a lifting of the anvil assembly 32 can be achieved to draw the anvil assembly 32 up more towards the chassis 3 when it has reached its lower wore limit. The rope or cable used to span between the frame support 41 and the anvil 32 may be tied off at a tie off point 44 of the support frame 41. The anvil 32 is preferably guided by the guide follower 107 along the guide track 50 of the support frame 41.

In a broad sense the operation of the impact driver 102 of the present invention involves the oscillating movement of the ram/reactor support 18 relative to the support frame 41 and hence relative the vehicle from which the impact driver 102 is mounted, as a result of the interaction between the LIM stator 16 and the reactor plate 15. The linear movement of the ram/reactor support 18, controlled by the LIM stator 16 is such as to generate sufficient kinetic energy in the ram/reactor support 18 for the purposes of driving an object linearly into a body such as for example the ground. The impact head 20 of the ram/reactor support 18 impacts onto the anvil 28 which itself is positioned to be engaged against the end of an object such as a post 51. The anvil 28 is floating relative to the support frame 41 and movable relative thereto in a linear manner. The anvil 28 is driven in such a linear manner by the impact of the impact head 20 (which imparts its kinetic energy onto the post 51) to progressively advance the post into for example the ground.

A sleeve (not shown) extending from the anvil 32 may also be provided for the purpose of locating about the post. Whilst the flange of the anvil 28 can provide some support to any lateral movement of the post 51, a sleeve of a sufficiently long length may extend from the end of the post along the post for the purposes of stabilising the post at least during the initial phase of the post being driven into the ground to prevent the post from moving in a lateral direction.

Once the anvil assembly 32 has been driven to its maximum telescopic extension relative to the chassis 3, a repositioning of the chassis 3 will need to occur by the repositioning of the support frame 41. When repositioned, the anvil assembly 32 can be telescopically retracted relative to the chassis 3 by the use of the pulley arrangement extending between the mounts 37 and 43. In an alternative form, it may be possible to substitute the pulley/cable arrangement for the purposes of retracting the anvil assembly 32 telescopically towards the chassis 3 by the LIM. The LIM can be used for retracting the anvil assembly 32 by using solenoids for example, to lock and unlock the component parts of the driver to allow lifting of the anvil 28.

Whilst in the preferred form the present invention is used for the driving of an object such as a post 51 into the ground 101, it will be appreciated that the present invention can also be used for the purposes of extracting a post from the ground. Means to fasten or grip a self attaching post clamp to allow posts to be withdrawn using an upwards motor thrust can be provided by the device. The operation of the invention to extract a post is effectively reversed. Impact forces generated by the movement of the ram/reactor support 18 can be transmitted by a post clamp to the post, to allow for the post to be gradually extracted from the ground. This mode of operation may have very useful application in situations where posts are located in the ground only for temporary purposes such as for example for anchoring a structure such as a tent. Tent posts and/or pegs can be removed from engagement in the ground by the use of the impact driver acting in reverse such as can be provided by the impact driver 102 of the present invention.

In order to ensure that the relative location of the rain/reactor support 18, to the LIM stator 16 and the location of the anvil assembly 32 relative to the support frame 41 is known, various sensors can be used. Optical or inductive sensors to detect the positioning of an object relative thereto are the most preferred means of detecting the relative position of components of the impact driver 102. An optical or more preferably an inductive sensor at location 34 of the anvil assembly 32 interactive with various sensing elements 48 spaced along the support frame 41 can be utilised for determination of the position or the reaching of a limit of movement of the anvil assembly 32 relative to the support frame 41. Such location determination can be used for the purposes of control of the impact driver 102. Likewise movement or at least positioning of the ram/reactor support 18 relative to the LIM stator 16 and the chassis 3 can be detected by the provision of a sensor at location 5 of the chassis 3. A corresponding sensor interaction means (such as the plate 19) of the ram/reactor support 18 can be provided for the purposes of communication with the sensor at location 5 of the chassis 3. Sensing of the position between the ram/reactor support 18 and the chassis 3 is for the purposes of ensuring that the LIM stator 16 does not displace the ram/reactor support beyond its limits relative to the chassis 3 and the LIM stator 16.

In additions to the most preferred embodiment described above with reference to the accompanying drawings, it is envisaged that some variations may be incorporated in the impact driver of the present invention. A range of anvils to suit post diameter may be provided. Nylon bearings in the support frame channel for anvil tube bracket could be utilised to enhance the ease of movement. The lower part of chassis tube may be lined with a nylon sleeve to prevent wear from anvil tube. Electro-mechanical interlocks ensure that the ram is not driven outside of the chassis, and also securely locks the chassis in position whilst moving the unit or placing a post in position for being driven.

Electrical power is preferably provided by the support vehicle, main power supply, battery-inverter or a stand alone generator.

Control and operation of the impact driver of the present invention is preferably electronic.

The electrical design comprises of a Linear Induction Motor (LIM), controller, power supply and may include various sensors and solenoids.

A positive current to the motor ensures that the ram is moved in a positive or impact direction (downwards i.e. towards the post) in the chassis.

The electrical components may include (1) A Linear Induction Motor to provide drive for the ram in its climbing mode and impact mode.

(2) A Controller to control motor direction and acceleration and provides all controls and distributes power and signals.

(3) An enable button.

(4) A the Fire button which causes n cycles of impaction as set by the cycle selector. Alternatively impaction continues until the switch is released.

Several enhancements can be accomplished through the use of improved sensing and control of the LIM, these relate to safety and further application areas and may include:

The drive sequence cannot be activated when the anvil is within a certain distance to of its lowest point of travel. This ensures that the device does not suffer damage. A suitable technique is to place an inductive sensor on the support frame to detect the anvil tube.

The drive sequence cannot be activated when no post is present. A suitable and probably only technique is to use high shock resistant optical sensors. The sensors would detect the presence of the post or any other foreign object. The logic would ensure the check is made prior to unlocking the anvil having first verified that a post is not present; then the post check is made having knowingly dropped the anvil onto the post.

The drive sequence enabled is timed out after say 20 seconds if no fire sequence is activated. This provides for additional safety to circumvent accidental firing.

The drive sequence cannot be activated when any sensor has failed or is disconnected. This is accomplished by monitoring the active current necessary to power the inductive sensors; a zero current would imply a malfunction.

The drive sequence cannot be activated unless the chassis moving mechanism is secured. This requires a logical check of the chassis moving mechanism.

The drive sequence cannot be activated if any solenoid locks are in place. This requires a logical check of the lock solenoids.

The anvil is mechanically locked to prevent falling when moved upwards and only released when a post is placed in situ.

The LIM force applied to both raise and drive the hammer can be controlled by adjusting either the motor voltage or acceleration and deceleration rates. Presently these are factory set but could be made available to a computer based controller or user activated selection switch. These parameters would need to be adjusted in order to calibrate known applied forces.

The addition of a range sensor for both the anvil to support and support to ground would enable accurate post set.

A laser location pointer could be used to easily indicate the relative ground location for the post with respect to the angle and position of the unit.

The remote control could be wireless.

All sensors are preferably of the inductive type with current monitors to ensure that both transmitter and receiver are functioning. In the event of a failure all operational modes are inhibited and the arm light flashes continuously.

The LIM may for example require a 3 phase 400 V supply at 15-30 Hz capable of continuous current of 30 A per phase needing for example 11015 kw (note might be able to half this requirement).

ADVANTAGES OF THE INVENTION

Some of the advantages of the present invention will be realised by a person skilled in the art. These include the ability for the invention to provide a light weight, modular unit that can be easily and rapidly mounted on a range of vehicles such as a farm bike, tractor, excavator arm, 4 wheel drive utility vehicle or boat. In addition, the unit is intended to be faster than conventional post drivers, is scalable to cater for different size posts and market costs, is extensible to cater for a wide range of post lengths, easy to break down for transportation and storage, capable of being mounted at rear, side or front of vehicle, operable from a range of power sources and, capable of alternative applications such as driving nails into post and rail fencing or concrete breaking.

The present invention is capable of being engaged to a flat bed truck, tractor, farm bike or related trailer, excavator arm, kanga, dingo or bobcat, a stand alone trailer trolley or derrick and is even able to be mounted to a floating vessel such as a barge or boat or the like. It has application in the agriculture and horticulture industries including for example vineyards, landscaping and the like. Because of its compact size and convenient handling, it will be attractive to incorporate in the suite of equipment provided by hire centres as it can be conveniently used by not just commercial operators but also DIY amateur users. When mounted on a boat or barge, the present invention has the ability for allowing the device to drive poles or piles for the construction or maintenance of wharves, jetties, seawalls and the like and because of its weight, does not require a substantial barge to carry the device. It will be appreciated that the design principles are independent of gravitational forces and hence the unit can be used for driving posts at any angle to the vertical. Hence the device of the present invention can be used for driving stabilising pins or pipes into near vertical walls or banks. However when used vertically and with the compression or impact stroke travelling downwards. The device takes advantage of not just the LIM force but also gravity. The device allows for a controlled and calculatable force to be applied to the post. This allows the device to be used as a scalar penetrometer for, for example determining the elastic constant of soil. The lightweight, modular construction and compact size of the device of the present invention allows for it to also be air deployed to be delivered to locations which are two remote for traditional impact drivers to be transported to.

With the use of electronic control, the invention also lends itself to applications requiring remote operation as for example in hazardous situations.

Scalability is achieved by choosing a suitably specified linear motor to suit the resistive forces of the ground into which the post is driven. Hence the same design can be scaled to provide a small scale unit operating horizontally, a medium size unit operating vertically for driving ordinary 1.8 m fence posts or Waratahs, or a large scale unit operating vertically for driving posts of up to 4.2 m in length and 300 mm diameter. In conventional post ramming or driving devices there is a large mass of some 200 kg dropped on to a post over a distance range from 100 cm to 3 meters. This releases an equivalent energy of 200 to 5,9000N.

In order to achieve the equivalent energies from kinetic energy, a mass of say 50 kg would need to be travelling at 2.8 to 15.3 meters per second after being subjected to constant acceleration of say for example 1 meter. This generation of energy conveniently achievable through the use of an LIM.

A comparison based on the following set of well known force and mass and energy equations as follows, can be conducted.

$$s=\tfrac{1}{2}*a*t^2 \text{ m}$$

$$v=sqrt(2*a*s) \text{ m/s}$$

$$\text{work}=F*s \text{ joule}$$

$$\text{power}=\text{work}*t \text{ watt}$$

$$F=m*a \text{ N}$$

$$PE=m*s$$

$$KE=\tfrac{1}{2}*m*v^2$$

$$g=9.81 \text{ m/s/s}$$

A benchmark based on the use of potential energy to achieve a sufficient driving force was used to determine a range of potential energy capable of being generated upon the impact of a hammer with an object to be impacted/driven by the hammer. The table below (Table 1) illustrates such benchmarking figures.

TABLE 1

| Measure | unit | Min | Average | Maximum |
|---|---|---|---|---|
| Falling mass | kg | 200 | 200 | 200 |
| Vertical fall | m | 0.3 | 0.6 | 2 |
| Potential Energy | joules | 588 | 1177 | 3924 |

In comparison, in reliance on a setup as hereinbefore described and wherein a total moving ram mass of 30 kilograms is utilised, it can be seen from Table 2 that over a travel distance of 1.4 meters, various accelerations (well within the ability of a linear motor) can provide substantially similar potential energy at impact of the hammer. The table below (Table 2) illustrates the various operating parameters. The last column in table 2 indicates the expected performance of the LIM. The LIM as designed is slightly below the average column or due the fast cycle time this is not considered critical provided ground static friction is overcome. In the case of the table below the estimates are based on kinetic energy equivalent. The maximum figures shown are possibly impractical to achieve given the large power requirement.

TABLE 2

| Measure | unit | Min | Average | Maximum | LIM | |
|---|---|---|---|---|---|---|
| Kinetic Energy | joules | 588 | 1177 | 3924 | 800 | |
| mass | kg | 30 | 30 | 30 | 25 | |
| Required velocity | $m/s^2$ | 6.3 | 8.9 | 16.2 | 8 | |
| Hammer travel | m | 1.4 | 1.4 | 1.4 | 1 | |
| acceleration | g-force | 1.4 | 2.9 | 9.5 | 3.1 | See note 1 |
| Travel time | s | 0.4 | 0.3 | 0.2 | | |
| Required force | N | 420 | 840 | 2802 | 740 | |
| Power | KVA | 8.4 | 16.8 | 56 | 14.8 | See note 2 |
| Current per phase | A | | | | 48 | |
| Startup overload | % | | | | 125 | |

Note
1. These calculations do not take account of gravitational force when the invention is used in a vertical plane.
2. Force power conversion = 20. N/kva Note
1. These calculations do not take account of gravitational force when the invention is used in a vertical plane.
2. Force power conversion=20.N/kva

The invention claimed is:

1. An impact driver for driving an elongate object into a body in any plane from the horizontal to the vertical, said impact driver comprising a) chassis, b) a ram supported by said chassis in a manner allowing rectilinear movement of said ram relative to said chassis, c) a linear induction motor including (i) a stator mounted to said chassis, and (ii) a linear induction motor reaction member composed of at least one plat of an electrically conductive material mounted to said ram, (iii) the stator being positioned to operatively interact with linear induction motor reaction member to accelerate the reaction member substantially along a length of movement of the reaction member to move the reaction member from a retracted position to an impact position, and from the impact position to the retracted position, d) whereby, when the said reaction member is accelerated to move from said retracted position to said impact position, the ram is accelerated at an increasing rate throughout its movement by the reaction member to substantially increase its kinetic energy for causing an impact force to be imparted on said elongate object in the elongate direction thereof.

2. The impact driver as claimed in claim 1, wherein said ram includes an impact head for receiving said impact force from the ram and transmitting it to an elongate object.

3. The impact driver as claimed in claim 2, wherein said ram includes an elongate ram support structure, said ram support structure having a first and second ends, and wherein said impact head is provided at a first end of said ram support structure.

4. The impact driver as claimed in claim 3, wherein said reaction member is of an elongate configuration, and is secured to the ram support structure to extend in the elongate direction of said ram support structure between said first and second ends thereof.

5. The impact driver as claimed in claim 2, wherein said impact head is of a robust and substantially solid material suitable for the transferal of an impact from the ram to the elongate object.

6. The impact driver as claimed in claim 1, wherein said chassis provides bearings which locate and support said ram for rectilinear movement within said chassis.

7. The impact driver as claimed in claim 6, wherein said bearings are located within a casing of said chassis, said ram also at least in part provided and retained by said bearings within said casing of said chassis.

8. The impact driver as claimed in claim 6, wherein said stator of said linear induction motor is positioned within the casing of said chassis.

9. The impact driver as claimed in claim 1, wherein said chassis includes a casing defining an elongate chamber within which at least part of said ram is able to move in the elongate direction.

10. The impact driver as claimed in claim 1, wherein the relative position of said ram at least when in one position with respect to said chassis is able to be sensed by an electronic sensor.

11. The impact driver as claimed in claim 10, wherein said electronic sensor is a limit sensor for detecting the reaching of the ram to or proximate to its retracted position.

12. The impact driver as claimed in claim 10, wherein said electronic sensor is in communication with a controller for controlling of the linear induction motor, in order for the electronic sensor to actuate the controller to accelerate the said ram from the retracted position to the impact position.

13. The impact driver as claimed in claim 1, wherein said stator is controlled to accelerate the ram from the retracted position to the impact position at a rate different and most usually greater than from the impact position to the retracted position.

14. The impact driver as claimed in claim 1, wherein an anvil assembly is positioned relative to said chassis to hold an anvil in alignment to the rectilinear direction of movement of said ram to be interposed between the head of said elongate object and said impact head for the purpose of providing a cushioning to the impact force of said ram applied to said elongate object.

15. The impact driver as claimed in claim 14, wherein said anvil assembly is in a translatable engagement with said chassis.

16. The impact driver as claimed in claim 14, wherein said anvil assembly presents said anvil at a location remote from said chassis.

17. The impact driver as claimed in claim 1, wherein said chassis is mounted to a support structure.

18. The impact driver as claimed in claim 14, wherein said chassis is mounted to a support structure and said anvil assembly is in a translatable engagement with said support structure to permit its movement relative thereto and parallel to the rectilinear direction of movement.

19. The impact driver as claimed in claim 1, wherein said support structure includes a mounting arrangement for mounting the chassis to a vehicle.

20. The impact driver as claimed in claim 19, wherein said mounting arrangement allows said support structure to rotate relative to said vehicle.

21. The impact driver as claimed in claim 19, wherein said mounting arrangement allows said support structure to translate relative to said vehicle.

22. The impact driver as claimed in claim 1, wherein said chassis is mounted to a support device selected from one of a vehicle, a vessel and a derrick.

23. The impact driver as claimed in claim 22, wherein said chassis is connected to the support device by an articulated mounting arrangement configured for mounting the chassis to the support device in an articulated manner.

24. The impact driver as claimed in claim 1, wherein the impact driver is a pile driver.

25. The impact driver as claimed in claim 1, wherein when said reaction member is accelerated to move from said retracted position to said impact position, the acceleration of the said ram is enhanced by the addition of a gravitational force component that increases from zero in the horizontal plane to a maximum additional acceleration of 9.81 $m/s^2$ in the vertical plane.

26. The impact driver as claimed in claim 1, wherein said elongate object can be extracted from said body by nature of the following arrangement:

a) said impact position and said retracted position are reversed with respect to said elongate object so that the said ram is accelerated away from said elongate object, b) said ram includes an engagement arrangement for engaging with said elongate object to transmit forces from the linear induction motor to the elongate object, thereby to extract the elongate object; and c) the movement of said ram being controllable though said linear induction motor to reduce said ram's impact on said elongate object to a lesser extent when said ram returns to a more proximate position to said elongate object between extraction strokes.

* * * * *